US011364722B2

(12) United States Patent
Luke et al.

(10) Patent No.: US 11,364,722 B2
(45) Date of Patent: Jun. 21, 2022

(54) PRINT SUBSTANCE DONOR CONTAINERS

(71) Applicant: HEWLETT-PACKARD DEVELOPMENT COMPANY, L.P., Spring, TX (US)

(72) Inventors: Jeff Luke, Boise, ID (US); Dean Richtsmeier, Boise, ID (US); Mathew Lavigne, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/969,378

(22) PCT Filed: May 21, 2018

(86) PCT No.: PCT/US2018/033597

§ 371 (c)(1),
(2) Date: Aug. 12, 2020

(87) PCT Pub. No.: WO2019/226143

PCT Pub. Date: Nov. 28, 2019

(65) Prior Publication Data

US 2020/0398578 A1 Dec. 24, 2020

(51) Int. Cl.
*B41J 2/175* (2006.01)

(52) U.S. Cl.
CPC ..... *B41J 2/17533* (2013.01); *B41J 2/17506* (2013.01); *B41J 2/17523* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/17533; B41J 2/1755; B41J 2/17553; B67D 7/02
See application file for complete search history.

(56) References Cited

U.S. PATENT DOCUMENTS

| | | | | |
|---|---|---|---|---|
| 5,734,400 | A | 3/1998 | Brunetti et al. | |
| 5,751,320 | A | 5/1998 | Scheffelin et al. | |
| 5,852,458 | A | 12/1998 | Scheffelin et al. | |
| 6,059,401 | A | 5/2000 | Wu et al. | |
| 6,130,695 | A * | 10/2000 | Childers | B41J 2/17506 347/85 |
| 6,164,768 | A * | 12/2000 | Murphy | B41J 2/17503 347/85 |
| 6,213,597 | B1 * | 4/2001 | Liu | B41J 2/17503 141/18 |
| 6,969,161 | B2 * | 11/2005 | Kuwabara | B41J 2/17509 347/85 |

(Continued)

FOREIGN PATENT DOCUMENTS

| | | |
|---|---|---|
| CN | 1386642 | 12/2002 |
| CN | 1906118 | 1/2007 |
| WO | WO-2005102872 | 11/2005 |

*Primary Examiner* — Anh T Vo
(74) *Attorney, Agent, or Firm* — Staas & Halsey LLP

(57) ABSTRACT

Example implementations relate to print substance donor containers. For example, a system comprising a receiving container with a receiving receptacle port and a donor container comprising a outlet probe to transport print substance material from the donor container to the receiving container in response to the outlet probe coupling with the receiving receptacle port of the receiving container.

15 Claims, 5 Drawing Sheets

(56) References Cited

U.S. PATENT DOCUMENTS

| | | | | |
|---|---|---|---|---|
| 7,004,564 | B2 * | 2/2006 | Steinmetz | B41J 2/1755 347/49 |
| 7,543,920 | B2 | 6/2009 | Wilson, II et al. | |
| 7,607,768 | B2 | 10/2009 | Miller | |
| 8,025,372 | B2 | 9/2011 | Umeda et al. | |
| 10,427,412 | B2 * | 10/2019 | Okude | B41J 2/03 |
| 2005/0151764 | A1 | 7/2005 | Grady et al. | |
| 2005/0231568 | A1 | 10/2005 | Wilson, II et al. | |
| 2012/0152977 | A1 | 6/2012 | Sekiyama et al. | |
| 2016/0355021 | A1 * | 12/2016 | Kanbara | B41J 2/1752 |
| 2017/0326882 | A1 * | 11/2017 | Okude | B41J 2/17553 |
| 2017/0355191 | A1 | 12/2017 | Mizutani et al. | |
| 2018/0043390 | A1 | 2/2018 | Rospierski | |

* cited by examiner

PRINT SUBSTANCE DONOR CONTAINERS

CROSS REFERENCE TO RELATED APPLICATIONS

This application is a U.S. National Stage Application which claims the benefit under 35 U.S.C. § 371 of International Patent Application No. PCT/US2018/033597 filed on May 21, 2018, the contents of which are incorporated herein by reference.

BACKGROUND

Containers can be utilized to contain, store, and/or transport substances. Containers can contain substances that can be dispensed from the containers. For example, some containers can be utilized to dispense print substances into other containers.

DETAILED DESCRIPTION

An imaging device such as a print system may use a print substance in the reservoir to create text, images, etc. on a physical medium. Examples of physical medium include paper, photopolymers, plastics, composite, metal, wood, among other types of physical mediums. However, the reservoir may have a finite amount of print substance in a volume of the reservoir at a given time.

The amount of print substance in the reservoir may be reduced during operation of the imaging device, for instance, due to application of print substance from the reservoir to a physical medium. At some point, an amount of print substance in the reservoir may be less than a threshold amount of print substance for the imaging device to operate as intended. As such, the reservoir may be filled/refilled to provide/maintain an amount of print substance in the reservoir that is greater than the threshold amount of print substance.

Some approaches attempting to refill a reservoir may employ holes and funnels. However, such approaches may result in spillage and/or leakage of print substance, causing print substance waste and air contamination. Some approaches may employ a valve to regulate the flow of the print substance. For example, a valve in a receiving device can regulate, direct or control the flow of the print substance by opening, closing, or partially obstructing various passageways via which print substance gets transferred to other containers. However, such approaches may result in spilled of print material, for instance, due to excess print substance being transferred to the valve.

Accordingly, the disclosure is directed to print substance donor containers. For instance, a system can include a receiving container comprising a receiving receptacle port and a donor container comprising an outlet probe, the donor container to transport print substance from the donor container to the receiving container in response to the outlet probe coupling to the receiving receptacle port of the receiving container, as detailed herein. That is, print substance transfer using donor containers can facilitate a clean interface between the donor container and a receiving container. For instance, a slideable sleeve can create a seal between the donor container and the receiving container, as detailed herein. As such, a print substance can be transferred and conducted without exposure to an environment surrounding the donor container and/or the receiving container.

Figure 1:
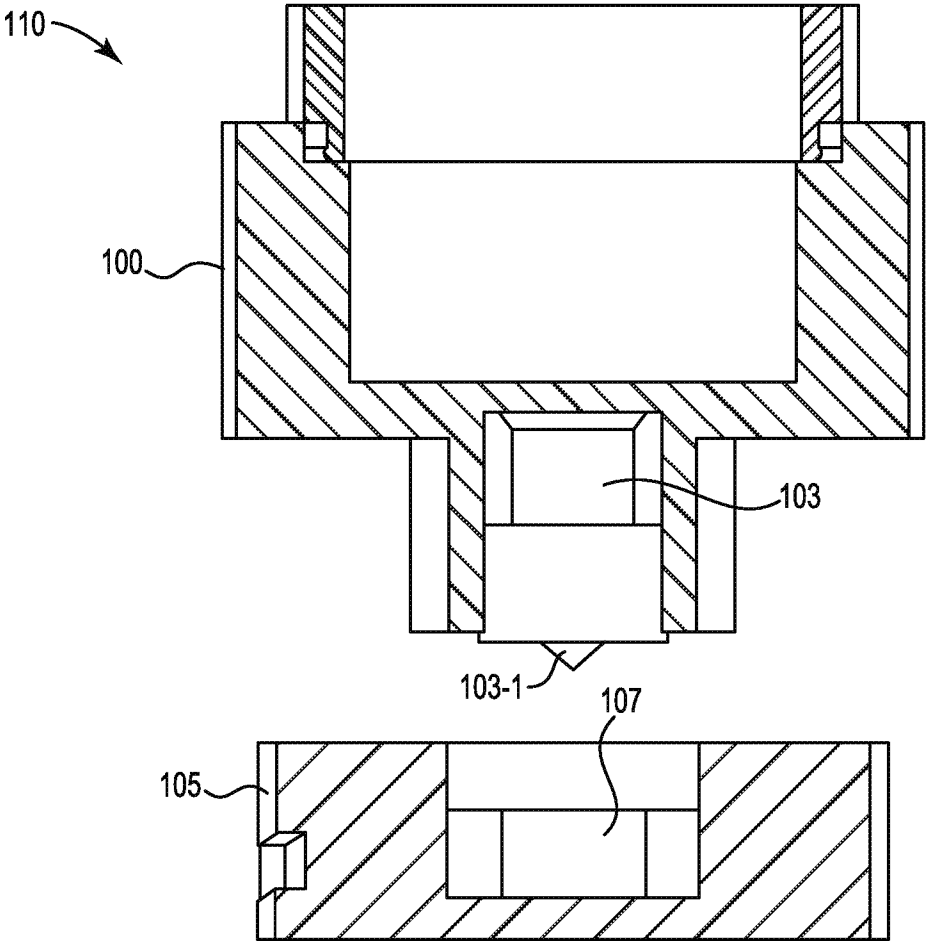
FIG. 1 illustrates a cross-sectional view of a system including a donor container with an outlet probe and a receiving container with a receiving receptacle port according to the disclosure.
Figure 4:
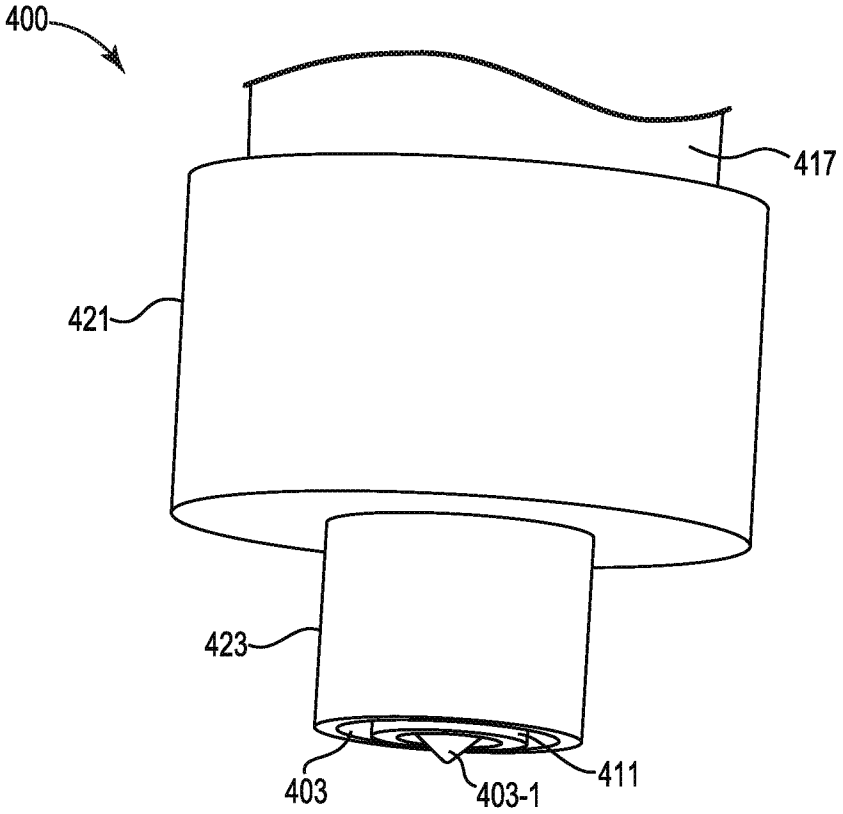
FIG. 4 illustrates a side view of a donor container according to the disclosure.

FIG. 1 illustrates a cross-sectional view of system 110 including a donor container 100 with an outlet probe 103 and a receiving container 105 with a receiving receptacle port 107 according to the disclosure. As used herein, the term, "outlet probe" refers to a probe with an aperture through which print substance can pass. For example, the outlet probe 103 can be positioned in an open position (as illustrated in FIG. 1) to allow a print substance to be transported out of the outlet probe. Conversely, the outlet probe can be positioned in a closed position (as illustrated in FIG. 4) to block a print substance from being transported out of the outlet probe. The open and/or closed positioned of the outlet probe may occur due to a position and/or movement of a slideable sleeve. For instance, a slideable sleeve can be a protective cover around the outlet probe that can retract from the outlet probe to expose an aperture on the outlet probe when slideable sleeve is in the open position or can be moved to cover the aperture, as described herein.

In some examples, the outlet probe of a donor container can couple with the receiving container. As the outlet probe inserts through a sealing cover, placed on the surface of the receiving receptacle port of the receiving container, a seal is formed between the donor container and the receiving container. In response to the seal, the slideable sleeve of the outlet probe can retract. As slideable sleeve retracts from the outlet probe, the aperture on the outlet probe are exposed, and print substance can transfer from the outlet probe of donor container to the receiving container.

Outlet probe 103 can be filled with, refilled with, and/or contain print substance. In some examples, the receiving receptacle port 107 of receiving container 105 includes a sealing cover, as detailed herein.

Figure 2:
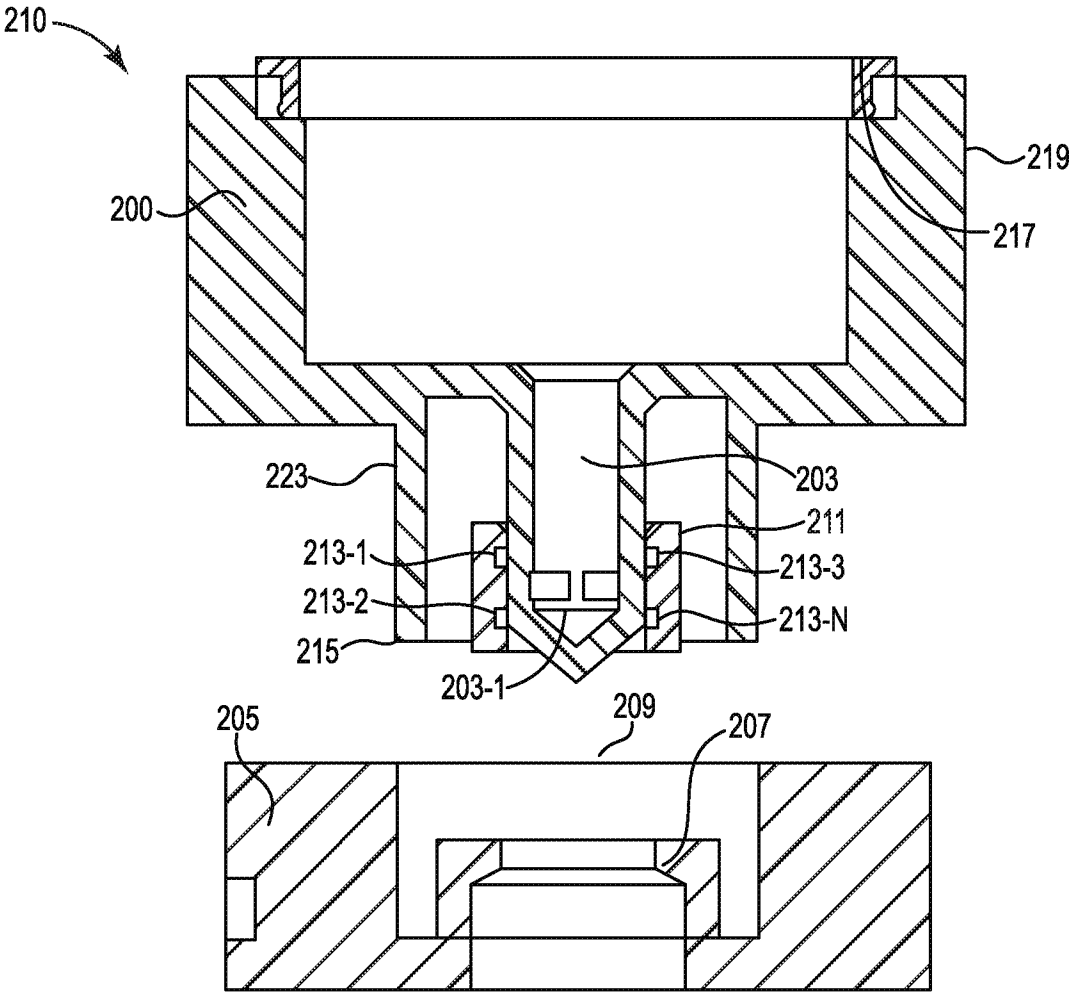
FIG. 2 illustrates a cross-sectional view of a system including a donor container with an outlet probe and a receiving container with a receiving receptacle port according to the disclosure.

In some examples, donor container 100 of system 110 can include a cylindrical body. In some examples, the cylindrical body can include a wall and a nozzle, (e.g., nozzle 223, as illustrated in FIG. 2). The nozzle encompasses outlet probe 103 of donor container 100. In some examples, donor container 100 can have a body shaped as a square, an oval, a triangular, among other possible geometries.

The print substance contained within donor container 100 can be liquid printing ink, a toner powder, a three-dimensional printing substance, etc. The print substance can be contained in and/or expelled from donor container 100. The donor container includes a donor receptacle port to reserve print substance. For example, the donor receptacle port can reserve print substance to refrain from using until system 110 is activated. In some examples, donor receptacle port can reserve print substance for future use. In some examples, system 110 can be activated by a user upon introducing force load on the donor container 100. In some examples, system 110 can be activated by a computing device and/or controller that includes instruction to activate system 110. The outlet probe 103 can include a slideable sleeve (e.g., slideable sleeve 211, as illustrated in FIG. 2) to facilitate transferring print substance from the donor container 100. In some examples, the print substance can flow into, out of, and/or through the outlet probe 103.

Outlet probe 103 can include an elongate body and a tapered tip on one end (e.g., tapered tip 203-1 as illustrated in FIG. 2). The tapered tip portion of outlet probe can be located at an end opposite to donor receptacle port. Outlet probe 103 can be made of thermoplastic and/or metal, among other types of materials.

Outlet probe 103 can include a slideable sleeve. As used herein, the term, "slideable sleeve" refers to a protective cover that is capable of sliding up and down an outlet probe, and/or well as retract axially in respect to the outlet probe. As mentioned, slideable sleeve can facilitate the transfer of print substance by opening and/or closing an aperture of the outlet probe. For instance, slideable sleeve of outlet probe 103 can facilitate print substance transfer from donor container 100 to receiving container 105 when the aperture of the outlet probe 103 are exposed. The tapered tip of outlet probe 103 can interfere with receiving container 105. Outlet probe 103 can insert through a sealing cover, placed on the surface of the receiving receptacle port 107 of the receiving container. Sealing cover can be made of tearable material for outlet probe 103 to be insert. As outlet probe 103 inserts through receiving container 105, donor container 100 and the receiving container 105 creates a seal. In response to the seal and the pressure created within the containers, the slideable sleeve of the donor container retracts axially, and moves clear of the aperture of the outlet probe 103. The aperture within the outlet probe 103 can be exposed, and print substance can be transferred from the outlet probe 103 of donor container 100 to the receiving container 103.

Donor container 100 can include outlet probe 103. In some examples, the outlet probe 103 can include a slideable sleeve. The slideable sleeve can include a wall encompassing the body of the outlet probe. In some examples, the slideable sleeve can be spring loaded. As the donor container 100 interferes with a receiving container 105, a vacuum is created. The vacuum triggers the loaded slideable sleeve to compress, and slideable sleeve to retract from the outlet probe 103 allowing the aperture of the outlet probe 103 to open and be utilized to transfer print substance from the donor container 100 to the receiving container 105. In some examples, donor container 100 can retract from receiving container 105, allowing the loaded slideable sleeve to decompress and extend towards the outlet probe 103. As the slideable, extends toward the outlet probe 103, the aperture of the outlet probe 103 can be covered and closed and print substance transfer through the outlet probe 103 can be ceased. In some examples, slideable sleeve can travel along the length of the outlet probe 103 and transfer print substance from various parts of the outlet probe 103 length.

Receiving container 105 of system 110 can include a body. In some examples, receiving container 105 can have a body shaped as a square, an oval, a triangular, among other possible geometries. Receiving container 105 can include a a receiving receptacle port 107. Receiving container 105 can be utilized to contain, store, and/or receive print substance from donor container 100. Receiving container 105 can have a compromised portion within which receiving receptacle port 107 is located. In some examples, receiving receptacle port 107 can be located in the center of the receiving container 105. The receiving receptacle port 107 includes a sealing cover, as described herein.

The donor container 100 and the receiving container 105 can include specialized complementary structures that facilitate the mating of the two together and introduce fluid communication between the two. For example, the donor container 100 and/or receiving container 105 can include complementary mating mechanisms which slide together in an interlocking fashion to mate the two together by aligning the nozzle of the donor container 100 with an opening of the receiving receptacle port 107 of the receiving container 105.

In some examples, the opening of receiving receptacle port 107 is sealed with a sealing cover (e.g., sealing cover 209 as illustrated in FIG. 2). The sealing cover can stop excess print substance from slipping past the sealing cover and reaching the receiving container. The sealing cover can sit within the receiving receptacle port 107. The sealing cover can be opened (e.g., torn) and/or removed as a tapered tip (e.g., tapered tip 203-1 as illustrated in FIG. 2) of outlet probe 103 inserts into the receiving receptacle port 107 of the receiving container 105. Responsive to the sealing cover being opened and/or removed the sealing material can be transported through the outlet probe 103 to transport a print substance, as described herein.

FIG. 2 illustrates a cross-sectional view of a system 210 including a donor container 200 with outlet probe 203 and, a receiving container 205 with a receiving receptacle port 207 according to the disclosure. System 210 is analogous to system 100, as described in FIG. 1. As illustrated in FIG. 2, system 210 can include a sealing cover 209 placed on the surface of the receiving receptacle port 207 of the receiving container. Device 200 can include a nozzle 223 which encompasses the outlet probe 203. Outlet probe 203 can include a tapered tip 203-1. Tapered tip 203-1 be located on a first side 215 of the donor container 200. Donor container 200 includes a donor receptacle port 217 on a second side 219 of the donor container 200. Donor receptacle port 217 can reserve print substance. Outlet probe 203 can include a slideable sleeve 211. Slideable sleeve 211 includes plurality of pockets 213-1, 213-2, . . . , 213-N. Pockets 213-1, 213-2 . . . , 213-N can be referred to collectively herein as pockets 213.

Slideable sleeve 211 can be a protective cover around the outlet probe 203. Slideable sleeve 211 can be a tube of metal, plastic, and/or other material. In some examples, slideable sleeve 211 can expose an aperture on the outlet probe 203 as slideable sleeve 211 retracts from the outlet probe 203. In some examples, slideable sleeve 211 can close and cover the aperture of the outlet probe, as slideable sleeve 211 extends to cover the aperture of the outlet probe 203. In some examples, outlet probe 203 can interfere with receiving container 205. In response to the interference with the receiving container 205, slideable sleeve 211 can compress, and retract axially along the outlet probe 203, moving clear of the of the aperture of the outlet probe 203. As the slideable sleeve moves clear of the aperture of the outlet probe 203, the aperture of the outlet probe 203 to can be exposed and be utilized to transfer print substance from the donor container 200 to the receiving container 205

Slideable sleeve 211 includes pockets 213. Pockets 213 can include O-rings, and/or other mechanical gaskets mounted in them. In some examples, the O-rings mounted in pockets 213 can create a seal at the interface of the outlet probe 203 and the slideable sleeve 211. As slideable sleeve 211 travels along the length of the outlet probe 203, O-rings mounted in pockets 213 can remain in static position. In some examples, pockets 213 can stop the leaking of print substance from the outlet probe 203 while slideable sleeve 211 is in closed position.

In some examples, the first side 215 of donor container 200 interferes with a receiving container 205 and creates a vacuum. The vacuum triggers the slideable sleeve 211 to compress causing the slideable sleeve 211 retract axially from the outlet probe 203 allowing the aperture of the outlet 203 to be exposed and be utilized to transfer print substance from the donor container 200 to the receiving container 205. In some examples, donor container 200 can retract from receiving container 205, allowing the slideable sleeve 211 to decompress and extend towards the outlet probe 303. As the slideable sleeve 211, extends toward the outlet probe 203, the aperture of the outlet probe 103 can be covered and closed and print substance transfer through the outlet probe 103 can be ceased. In some examples, slideable sleeve 211 can travel along the length of the outlet probe 203 and transfer print substance from various parts of the outlet probe 203 length.

In some examples, the first side 215 of donor container 200 interferes with a receiving container 205. As the first side 215 of the donor container 200 interferes with the receiving container 205, the nozzle 223 encompassing the outlet probe 203 interferes with the receiving container and the tapered tip 203-1 tears through sealing cover 209 placed on the surface of the receiving receptacle port 207 of the receiving container 205. In response to tapered tip 203-1 inserting into receiving receptacle port 207, receiving container 205 receives donor container 200.

As described herein, the sealing cover 209 can be moveable using tapered top 203-1 of the outlet probe 203. Outlet probe 203 can move the entire length of the receiving receptacle port 207. In some examples, outlet probe 203 can move the partial length of the receiving receptacle port 207. While gravity can assist this movement, additional force loads can be transferred to the donor container to facilitate the movement of outlet probe 203. In some examples, the force load can be introduced by a user of the donor container 200.

The interface between the donor container 200 and receiving container 205 of system compresses slideable sleeve 211 and causes the slideable sleeve 211 to retract axially from the outlet probe 203 allowing the aperture of the outlet probe 203 to be exposed and be utilized to transfer print substance from the donor container 200 to the receiving container 205.

Figure 3:
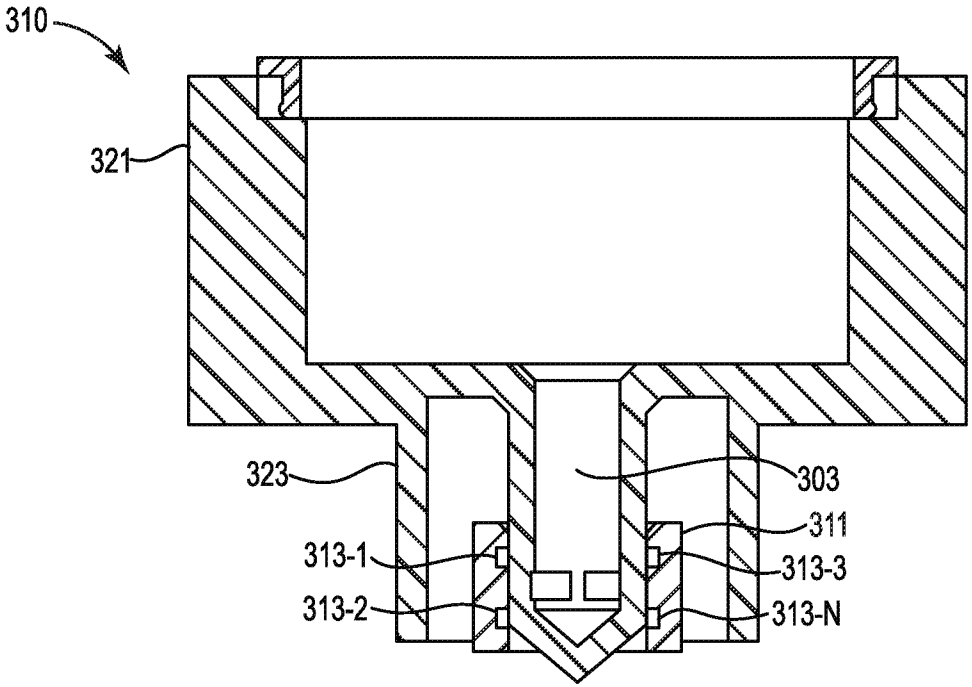
FIG. 3 illustrates a cross-sectional view of a donor container according to the disclosure.

FIG. 3 illustrates a cross-sectional view of a donor container 300 according to the disclosure. Donor container 300 includes a body 321, a nozzle 323, and an outlet probe 303. The outlet probe 303 includes a slideable sleeve 311 and a plurality of pockets 313-1, 313-2 . . . 313-N. Pockets 313-1, 313-2 . . . -313-N can be referred to collectively herein as pockets 313. The nozzle 323 encompasses outlet probe 303 of donor container 300. Nozzle 323 can be extended from the body 321.

In some examples, the donor container 300 can include a printing substance reservoir or cartridge. For example, the donor container 300 can be a portion of a printing device that serves as a reservoir for the print substance until a time when the print substance is to be utilized for a printing operation of the printing device.

In some examples, donor container 300 can include a body 321 with a wall and hollow space within the wall. In some examples, donor container 300 can have a body shaped as a square, an oval, a triangular, among other possible geometries. The donor container 300 can be sealed from the external environment. Donor container 300 can include a donor receptacle port to reserve a print substance, as described herein.

In some examples, donor container 300 includes a nozzle 323. Nozzle 323 can be a part that is separate from the body 321 but is fixed to the body 321 by fastening means. In other examples, the nozzle 323 and the body 321 can be two portions of an individual molded assembly. The nozzle 323 can include a wall shaped to control the direction and/or characteristics of the flow of the print substance from the donor receptacle port.

In some examples, the nozzle 323 can encompass the outlet probe 303. The walls and/or diameter of the nozzle 323 can define the diameter of the outlet probe 303 placed inside the nozzle 323. In some examples, the walls of the nozzle 323 can be tapered to facilitate the outlet probe 303 which includes a tapered tip. In some examples, nozzle 323 can include an opening through which the tapered tip of the outlet probe 303 travels thorough and interferes with a receiving container, as described herein.

The outlet probe 303 can include a slideable sleeve 311 to facilitate the transfer of print substance. In some examples, the print substance can flow into, out of, and/or through the outlet probe 303. Outlet probe 303 can include an elongate body and a tapered tip on one end. The tapered tip portion of outlet probe 303 can be located at an end opposite to donor receptacle port. The slideable sleeve 311 facilitates the transfer of print substance by opening and closing an aperture of the outlet probe 303.

Outlet probe 303 can be utilized as a plunger in a syringe. For example, outlet probe 303 can be moveable along an entire length of the nozzle 323. The outlet probe 303 can travel along the entire length of nozzle 303 and interfere with the surface of a receiving container without allowing print substance to be expelled until proper force is exerted on the tapered tip of outlet probe 303 to penetrate a sealing cover of the receiving container. Force loads can be transferred to the donor container 300 to facilitate the movement of outlet probe 303. In some examples, the force load can be introduced by a user of the donor container 300.

Slideable sleeve 311 can be a protective cover around the outlet probe 303. Slideable sleeve 311 can be a tube of metal, plastic, and/or other material. In some examples, slideable sleeve 311 can open to expose an aperture on the outlet probe 303 when slideable sleeve 311 is in an open position. In some examples, slideable sleeve 311 can be moved to close and cover the aperture of the outlet probe, as described herein. As outlet probe 303 interferes with receiving container 303, slideable sleeve 311 can compress, and retract axially from the outlet probe 303 allowing the aperture of the outlet 303 to open and be utilized to transfer print substance from the donor container 300 to a receiving container (e.g., receiving container 205 as illustrated in FIG. 2).

Slideable sleeve 311 includes pockets 313. Pockets 313 can have O-rings, and/or other mechanical gaskets mounted in them. In some examples, the O-rings mounted in pockets 313 can create a seal at the interface of the outlet probe 303 and the slideable sleeve 311. As slideable sleeve 311 travels along the length of the outlet probe 303, O-rings mounted in pockets 313 can remain in static position. In some examples, pockets 313 can stop the leaking of print substance from the outlet probe 303 while slideable sleeve 311 is in closed position.

In some examples, donor container 300 interferes with a receiving container and creates a vacuum. The vacuum triggers the slideable sleeve 311 to compress and to retract from the outlet probe 303 allowing the aperture of the outlet probe 303 to open and be utilized to transfer print substance from the donor container 300 to the receiving container. In some examples, donor container 300 can retract from receiving container allowing the slideable sleeve 311 to decompress and extend towards the outlet probe 303. As the slideable sleeve 311 extends toward the outlet probe 303, the aperture of the outlet probe 303 can be covered and closed and print substance transfer through the outlet probe 303 can be ceased. In some examples, slideable sleeve 311 can travel along the length of the outlet probe 303 and transfer print substance from various parts of the outlet probe 303 length.

In some examples, the slideable sleeve 311 can be spring loaded. As the donor container 300 interferes with the receiving container, slideable sleeve 311 can compress and the aperture of the outlet probe 303 can open and be utilized to transfer print substance. In some examples, donor container 300 can retract from the receiving container, allowing the spring loaded slideable sleeve 311 to decompress, and extend towards the outlet probe 303. As the slideable sleeve 311, extends toward the outlet probe 303, the aperture of the outlet probe 303 can be covered and closed and print substance transfer through the outlet probe 303 can be ceased.

In some examples, a slideable sleeve 311 can be a protective cover around the outlet probe 303. Slideable sleeve 311 can obstruct the aperture of the outlet probe 303 by remaining in closed position and keep outlet probe 303 from transporting print substance.

In some examples, slideable sleeve 311 of outlet probe 303 facilitates print substance transfer from donor container 300 to receiving container. The tapered tip of outlet probe 303 can interfere with receiving container. Outlet probe 303 can insert through a sealing cover, placed on the surface of the receiving receptacle port of the receiving container. Sealing cover can be made of tearable material (e.g., a metal foil or other material) through which outlet probe 303 to be inserted. As outlet probe 303 inserts through receiving container, donor container 300 and the receiving container creates a seal. In response to the seal and the pressure created within the containers, the slideable sleeve 311 of the donor container slides open.

FIG. 4 illustrates a side view of a donor container 400 according to the disclosure. Donor container 400 includes a donor receptacle port 417, a body 421, a nozzle 423 and outlet probe 403, and a slideable sleeve 411. Nozzle 423 encompasses outlet probe 403. Outlet probe 403 can include an elongate body and a tapered tip 403-1 on one end. The tapered tip portion 403-1 of outlet probe 403 can be located at an end opposite to donor receptacle port 417.

Donor container 400, as illustrated in FIG. 4, includes an outlet probe 403 in a retracted position. In some examples, donor container 400 can remain in an inactive state. Inactivate state of a donor container 400 can refer to outlet probe 403 to be in a retracted position and refraining from print substance transfer. In some examples, donor container 400 can be in an inactive state upon completing a print substance transfer event from donor container 400 to a receiving container, as described herein. In some examples, donor container 400 can be in an active state as print substance in a print system reaches less than a threshold amount.

In some examples, donor container 400 can be in an inactive state as outlet probe 403 is in a retracted position. In some examples, outlet probe 403 can be in a retracted position as the tapered tip 403-1 retracts from a surface of a receiving container, as described herein. As outlet probe 403 remains retracted, slideable sleeve 411 remains in a decompressed position. The decompressed position of slideable sleeve 411 can cause a aperture to be closed and cease the print substance to be transported from the outlet probe 403 to the receiving container.

Figure 5:
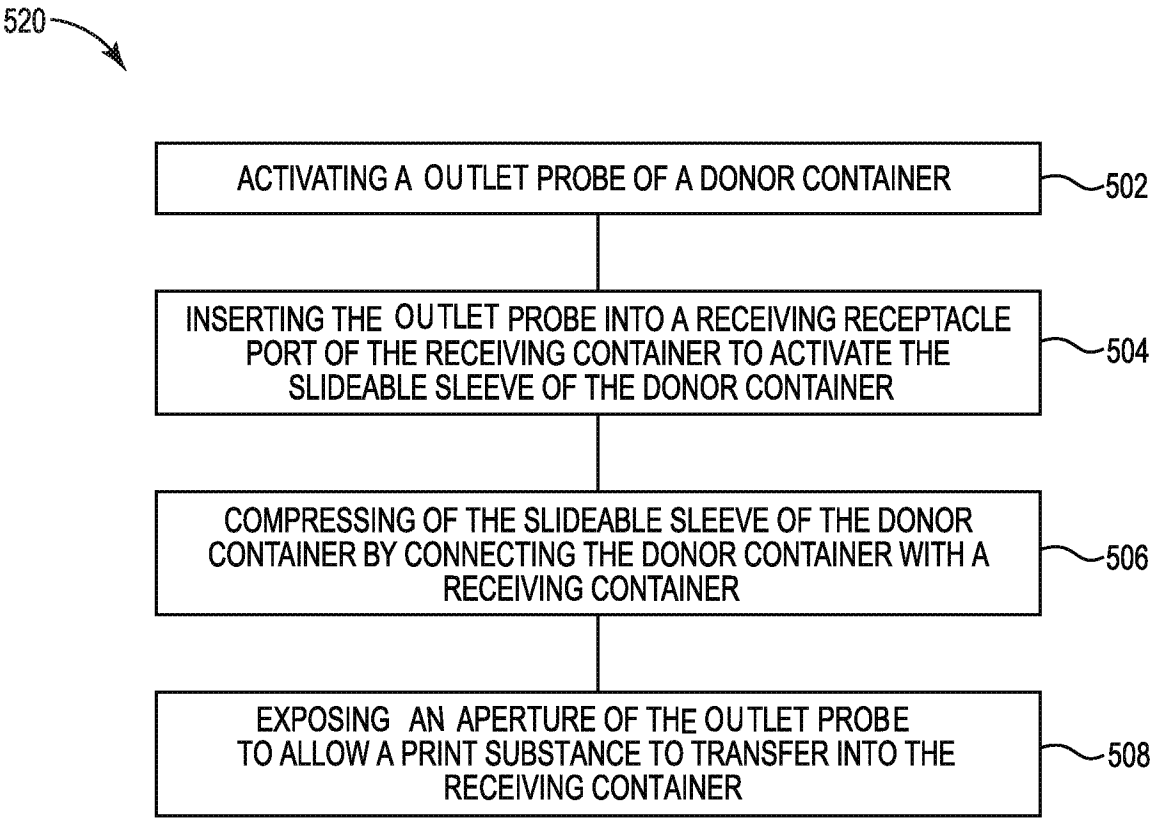
FIG. 5 illustrates an example method for transferring print substance from an outlet probe of a donor container using a slideable sleeve according to the disclosure.

FIG. 5 illustrates an example method 520 for transferring print substance from outlet probe of a donor container using a slideable sleeve according to the disclosure. In some examples, method 520 can be performed with a system such, as system 110 illustrated in FIG. 1. In some examples, a print system having a computing device and/or controller that includes instructions can be executed to perform the method 520.

At 502, method 520 includes activating an outlet probe of a donor container. Activation of the outlet probe induces the outlet probe and facilitates the outlet probe to travel along the nozzle of the donor container towards a receiving container. In some examples, outlet probe of a donor container is activated as print substance reaches a lower than average threshold level. In some examples, outlet probe of the donor container is activated at a predetermined time interval. Outlet probe can be filled with, refilled with, and/or contain print substance. Outlet probe can include an elongate body and a tapered tip on one end. Outlet probe can include a slideable sleeve which facilitates the transfer of print substance by opening and closing a aperture of the outlet probe. In some examples, the print substance can flow into, out of, and/or through the outlet probe.

In some examples, the outlet probe can travel along the entire length of the nozzle of donor container and interfere with the surface of a receiving container without allowing print substance to be expelled until proper force is exerted. While gravity can assist this movement, additional force loads can be transferred to the donor container to facilitate the movement of outlet probe. In some examples, the force load can be introduced by a user of the donor container. In some examples the force load can be introduced by a computing device and/or controller that includes instruction.

At 504, method 520 includes inserting the outlet probe into a receiving receptacle port of the receiving container to activate the slideable sleeve of the donor container. Activating the slideable sleeve refers to pressing the slideable sleeve into a position to reduce in volume and forcing an aperture on an outlet probe to open. For example, pressing a slideable sleeve with adequate force for the O-rings mounted into a plurality pockets of the slideable sleeve to function as a seal for a device. In some examples, as the outlet probe interferes with the receiving container, the slideable sleeve can compress, and retract axially along the outlet probe, moving clear of the aperture of the outlet probe. As the slideable sleeve moves clear of the aperture of the outlet probe, the aperture of the outlet probe can be exposed and be utilized to transfer print substance from the donor container to the receiving container.

As the outlet probe inserts through a sealing cover, placed on the surface of the receiving receptacle port of the receiving container, a seal is formed between the donor container and the receiving container. In response to the seal, the slideable sleeve of the donor container is induced to slide open. As slideable sleeve opens, the aperture on outlet probe are exposed, and print substance can transfer from the outlet probe of donor container to the receiving container. The compression of the slideable sleeve can trigger the aperture of the outlet probe to further open.

In some examples, the slideable sleeve can include a plurality of pockets. The plurality of pockets can include O-rings, and/or other mechanical gaskets mounted in them. In some examples, the O-rings mounted in pockets can create a seal at the interface of the outlet probe and the slideable sleeve. As slideable sleeve travels along the length of the outlet probe, O-rings mounted in the plurality of pockets can remain in static position. In some examples, the O-rings mounted pockets can stop the leaking of print substance from the outlet probe while slideable sleeve is in closed position.

At 506, method 520 includes compression of the slideable sleeve of the donor container by connecting the donor container with a receiving container. In some examples, the receiving container includes a receiving receptacle port. The sealing cover of receiving receptacle port can stop excess print substance to slip past the sealing cover and reach receiving container. The sealing cover can sit within the receiving receptacle port. The sealing cover can be torn as the tapered tip of outlet probe inserts the receiving receptacle port of the receiving container. The sealing cover can be moveable throughout the outlet probe to advance a print substance from donor container to receiving container.

At 508, method 520 includes exposing an aperture of the outlet probe to allow a print substance to transfer into the receiving container. The aperture of the outlet probe remains in obstructed position when the slideable sleeve is in decompressed position.

In some examples, as the donor container interferes with a receiving container it creates a vacuum within the system 110. The vacuum triggers the slideable sleeve to compress causing the slideable sleeve to retract from the outlet probe and allowing the pockets of the slideable sleeve to open and be utilized to transfer print substance from the donor container to the receiving container. In some examples, donor container can retract from receiving container, allow the slideable sleeve to decompress, and extend towards the outlet probe. As the slideable, extends toward the outlet probe the aperture of the outlet probe can be covered and closed and print substance transfer through the outlet probe can be ceased. In some examples, as the outlet probe inserts into the receiving container, the donor container and the receiving container slide together in an interlocking fashion. As the two containers mate together, donor receptacle port of the donor container remains in a sealed position.

In some examples, method 520 can transfer print substance from various parts of the outlet probe length and reduce the amount of print substance stranded in the donor container. With the reduction of stranded print substance in the donor container, less print substance is wasted.

As used herein, "a", "an", or "a number of" something can refer to one or more such things, while "a plurality of" something can refer to more than one such thing. For example, "an aperture" can refer to one or more apertures, while a "plurality of pockets" can refer to more than one pocket.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure and should not be taken in a limiting sense.

What is claimed:

1. A system comprising:

a receiving container comprising a receiving receptacle port; and a donor container comprising an outlet probe, the donor container to transport print substance from the donor container to the receiving container in response to the outlet probe coupling to the receiving receptacle port of the receiving container, wherein the outlet probe of the donor container comprising a slideable sleeve including a protective cover capable of sliding up and down the outlet probe.

2. The system of claim 1, wherein the slideable sleeve is capable of retracting axially with respect to the outlet probe.

3. The system of claim 2, wherein the slideable sleeve includes a plurality of pockets.

4. The system of claim 2, wherein the outlet probe comprises a tapered tip to contact the receiving receptacle port of the receiving container.

5. The system of claim 1, wherein the donor container comprises a donor receptacle port.

6. The system of claim 1, wherein the receiving receptacle port of the receiving container receives the outlet probe to open an aperture of the outlet probe.

7. The system of claim 1, wherein the donor container is to seal the receiving container responsive to the outlet probe coupling to the receiving receptacle port of the receiving container.

8. A donor container comprising:

a body;

an outlet probe comprising:

a slideable sleeve including a protective cover capable of sliding up and down the outlet probe; and an aperture; and a nozzle extended from the body to receive the slideable sleeve responsive to the donor container being triggered to open the slideable sleeve to expose the aperture of the outlet probe for transport of print substance.

9. The donor container of claim 8, wherein the nozzle encompasses the outlet probe.

10. The donor container of claim 8, wherein the slideable sleeve is in an open position as the outlet probe enters a receiving receptacle port of a receiving container, and the slideable sleeve is in a closed position as the outlet probe retracts from the receiving receptacle port of a receiving container.

11. The donor container of claim 8, wherein the slideable sleeve is configured to open and close the aperture of the outlet probe.

12. A method comprising:

activating an outlet probe of a donor container;

inserting the outlet probe into a receiving receptacle port of the receiving container to activate a slideable sleeve of the donor container;

compressing the slideable sleeve of the donor container to slide up or down the outlet probe by connecting the donor container with a receiving container; and exposing an aperture of the outlet probe to allow a print substance to transfer into the receiving container.

13. The method of claim 12, further comprising exposing the receiving receptacle port located in the receiving container.

14. The method of claim 13, further comprising exposing the receiving receptacle port by piercing a sealing cover of the receiving receptacle port using the activated outlet probe to permit transfer of the print substance from the donor container to the receiving receptacle port.

15. The method of claim 14, further comprising:

transferring print substance from the donor container to the receiving receptacle port; and sealing the donor receptacle port in response to the outlet probe inserting into the receiving container to transfer print substance.

* * * * *